US010683149B2

(12) United States Patent
Rasmussen

(10) Patent No.: US 10,683,149 B2
(45) Date of Patent: Jun. 16, 2020

(54) CONTAINER ASSEMBLY FOR ACCOMMODATING A BEVERAGE, A PREFORM ASSEMBLY FOR PRODUCING A CONTAINER ASSEMBLY AND A METHOD OF PRODUCING A CONTAINER ASSEMBLY

(71) Applicant: Carlsberg Breweries A/S, Copenhagen V (DK)

(72) Inventor: Jan Norager Rasmussen, Olstykke (DK)

(73) Assignee: CARLSBERG BREWERIES A/S, Copenhagen V (DK)

( * ) Notice: Subject to any disclaimer, the term of this patent is extended or adjusted under 35 U.S.C. 154(b) by 281 days.

(21) Appl. No.: 15/567,767

(22) PCT Filed: Apr. 20, 2016

(86) PCT No.: PCT/EP2016/058699
§ 371 (c)(1),
(2) Date: Oct. 19, 2017

(87) PCT Pub. No.: WO2016/169951
PCT Pub. Date: Oct. 27, 2016

(65) Prior Publication Data

US 2018/0118426 A1 May 3, 2018

(30) Foreign Application Priority Data

Apr. 21, 2015 (EP) ..... 15164508
Jul. 21, 2015 (EP) ..... 15177738

(51) Int. Cl.
*B65D 51/16* (2006.01)
*B65D 53/02* (2006.01)
(Continued)

(52) U.S. Cl.
CPC ..... *B65D 51/1661* (2013.01); *B65D 1/023* (2013.01); *B65D 1/0246* (2013.01);
(Continued)

(58) Field of Classification Search
CPC ..... B65D 51/1661; B65D 1/0246; B65D 1/0292; B65D 53/02; B65D 53/00; B65D 85/72; B65D 51/1668
(Continued)

(56) References Cited

U.S. PATENT DOCUMENTS 601,698 A * 4/1898 Backhaus ..... B65D 51/1661 215/260
1,998,646 A * 4/1935 Yager ..... A61J 9/04 215/11.5
(Continued)

FOREIGN PATENT DOCUMENTS

CN 2378333 5/2000

OTHER PUBLICATIONS

International Search Report on corresponding PCT application (PCT/EP2016/058699) from International Searching Authority (EPO) dated Jul. 1, 2016.
(Continued)

*Primary Examiner* — Gideon R Weinerth
(74) *Attorney, Agent, or Firm* — Klein, O'Neill & Singh, LLP

(57) ABSTRACT

A container (10) assembly for accommodating a carbonated beverage defining a temperature dependent internal carbonization pressure comprises a beverage container (10, 12) having a body part defining an inner volume for accommodating the carbonated beverage and a cylindrical neck part defining a gas filled head space. The cylindrical neck part further defines a circumferential rim (16, 18) defining an
(Continued)

opening (18, 20) and an outwardly oriented surface (24, 26) which extends between the rim (16, 18) and the body part, and has an outwardly oriented circumferential flange (20, 22). The beverage container (10, 12) further defines a burst pressure being higher than the temperature dependent internal carbonization pressure at room temperature. A closure (30, 32) is provided and comprises a closure plate (32, 34) and a cylindrical part. The closure plate (32, 34) covers the opening (18, 20) at the rim (16, 18) and the cylindrical part covers the neck part. The cylindrical part comprises a locking part for arresting the outwardly oriented circumferential flange (20, 22). A flexible sealing ring (10, 40) is provided and is movable between a first position in which the sealing ring (10, 40) is accommodated in a compressed state entirely within a circumferential cavity defined between the cylindrical part of the closure (30, 32) and the outwardly oriented surface (24, 26) of the neck part when the temperature dependent internal carbonization pressure is lower than or equal to the temperature dependent internal carbonization pressure at room temperature, and, a second position in which a larger part of the sealing ring (10, 40) is accommodated in a compressed state within the circumferential cavity, and a smaller part of the sealing ring (10, 40) is located in an uncompressed state within a groove (28, 30) in the cylindrical part and/or in the outwardly oriented surface (24, 26).

15 Claims, 5 Drawing Sheets

(51) Int. Cl.
*B65D 43/02* (2006.01)
*B65D 1/02* (2006.01)
*B65D 85/72* (2006.01)

(52) U.S. Cl.
CPC ..... *B65D 1/0292* (2013.01); *B65D 53/02* (2013.01); *B65D 85/72* (2013.01)

(58) Field of Classification Search
USPC ..... 215/45, 317, 260, 307, 11.5, 902; 220/366.1, 367.1, 795, 796, 797, 784, 220/203.09, 203.11, 203.12, 304; 426/118
See application file for complete search history.

(56) References Cited

U.S. PATENT DOCUMENTS 2,019,376 A * 10/1935 Wilhelm ..... B65D 43/0212 220/795
2,056,124 A * 9/1936 Pierson ..... A61J 9/04 215/11.5
2,099,711 A * 11/1937 Townsend ..... B65D 41/16 215/302
2,138,376 A * 11/1938 Griswold ..... B65D 51/1688 215/260
2,423,295 A * 7/1947 Crabbe ..... B65D 41/045 215/260
2,437,515 A * 3/1948 Glocker ..... B65D 51/1677 215/262
2,453,664 A * 11/1948 Hohl ..... B65D 51/1688 215/260
2,552,642 A * 5/1951 Morrison, Jr. ..... A47J 27/09 220/203.12
3,011,671 A * 12/1961 Waber ..... B65D 51/1661 215/260
3,043,463 A * 7/1962 Beall, Jr. ..... B65D 51/1661 215/260
3,181,720 A 5/1965 N M Cassie et al.
3,181,780 A 5/1965 Cassie et al.
3,433,379 A * 3/1969 Feofanovich ..... B65D 43/0222 215/260
4,007,848 A * 2/1977 Snyder ..... B65D 41/348 215/44
4,231,489 A 11/1980 Malone
5,465,864 A 11/1995 McClean
6,015,062 A * 1/2000 Bachmann ..... B21D 51/38 220/295
6,299,006 B1 * 10/2001 Samonek ..... B65D 23/00 116/112
10,544,026 B2 * 1/2020 Rasmussen ..... B65B 31/046
2006/0060554 A1 * 3/2006 Garman ..... B29C 49/0073 215/43
2008/0078769 A1 4/2008 Crunkleton, III et al.
2014/0097184 A1 * 4/2014 Hollars ..... F17C 13/06 220/258.4
2018/0118426 A1 * 5/2018 Rasmussen ..... B65D 1/023

OTHER PUBLICATIONS

Written Opinion on corresponding PCT application (PCT/ EP2016/058699) from International Searching Authority (EPO) dated Jul. 1, 2016.

* cited by examiner

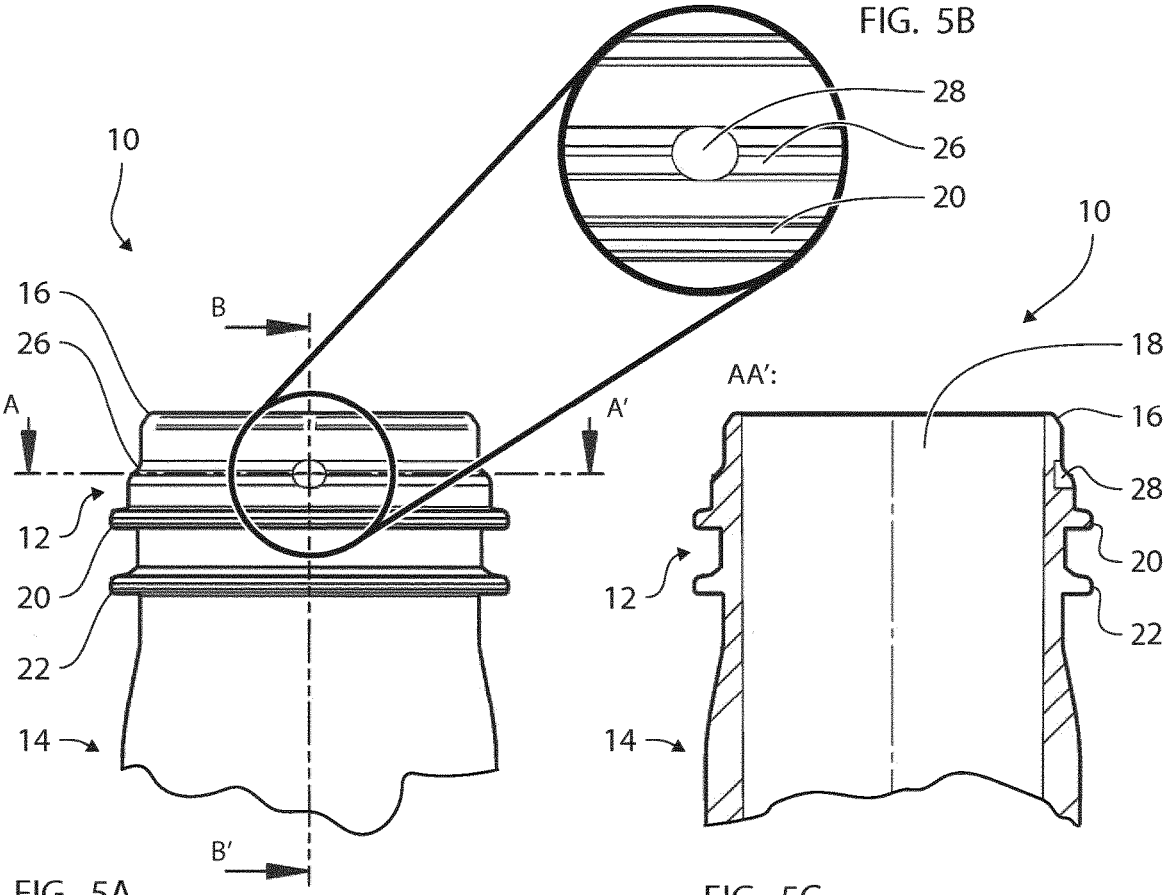
FIG. 5A
FIG. 5C
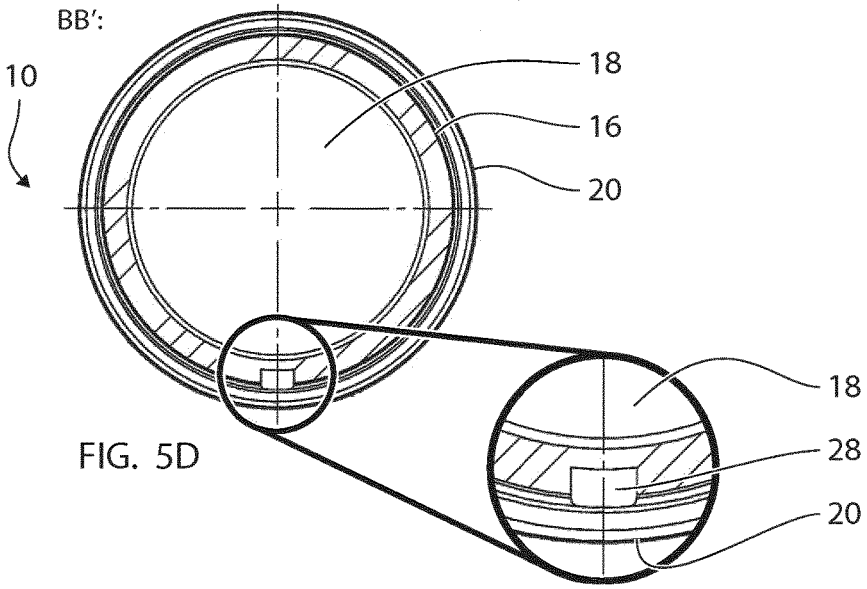
FIG. 5D
FIG. 5E

CONTAINER ASSEMBLY FOR ACCOMMODATING A BEVERAGE, A PREFORM ASSEMBLY FOR PRODUCING A CONTAINER ASSEMBLY AND A METHOD OF PRODUCING A CONTAINER ASSEMBLY

CROSS-REFERENCE TO RELATED APPLICATIONS

This application is the national phase entry, under 35 U.S.C. Section 371(c), of International Application No. PCT/EP2016/058699, filed Apr. 20, 2016, claiming priority from European Application Nos. 15164508.2, filed Apr. 21, 2015, and 15177738.0, filed Jul. 21, 2015. The disclosures of the International Application and the European Applications from which this application claims priority are incorporated herein by reference in their entireties.

FEDERALLY SPONSORED RESEARCH OR DEVELOPMENT

Not Applicable

The present invention relates to a container assembly for accommodating a beverage, a preform assembly for producing a container assembly and a method of producing a container assembly.

Introduction

Historically, beverages have been transported from the place of production to the place of consumption in containers such as bottles made of glass or alternatively in kegs made of metal or wood. Nowadays, plastic and preferably PET is increasingly being used for transporting beverage replacing both glass bottles and metal and wooded containers.

One advantage of using plastic containers instead of glass, metal or wooden containers is the significantly less weight of plastic containers. Further, plastic containers may be blow molded out of preforms just before filling the beverage, and after the container has been emptied of beverage at the place of consumption, or even during tapping, the beverage container may be collapsed, i.e. compressed or compacted, to a much smaller size compared to the originally filled size.

Yet further, the plastic containers may be recycled in an environmentally friendly way either by melting in order to re-use the raw material, or by combustion resulting apart from generation of carbon dioxide and water in the recovery of energy. Containers made of glass, metal or wood are more difficult to recycle and typically must be transported back to the beverage producer for cleaning or alternatively to the manufacturer for being melted down under high temperature and re-used as raw material, both options resulting in environmental impact in the form of energy use and possible use of toxic substances.

In order to save on material it is desirable to use as thin walled containers as possible. Storing pressurized beverages, such as carbonated beverage, in thin walled containers will on the other hand increase the risk of rupturing the container. A rupture may in addition to the complete loss of the beverage stored in the container also result in personal injury or damage on property due to debris from the rupturing container. Ruptures may occur due to accidental piercing of the container, however, the most violent ruptures may be caused by an increase of the pressure inside the container.

As the pressure inside the container is directly dependent on the temperature of the beverage, rupture may occur as a result of a fire close to the location of the container or by leaving the container in a hot location such as in direct sunlight or inside an enclosed space which is being heated by sunlight. Further, fermented beverages such as beer release a large amount of carbon dioxide during the fermentation. When the beverage has been sealed in the container, the fermentation should have stopped or at least continue in a predictable way. In case the fermentation continues in an uncontrolled way when the beverage has been sealed within the container, the pressure increase caused by the gas produced during the uncontrolled fermentation may cause the container to rupture. Thus, there is a need to make such containers pressure safe.

Ruptures due to pressure increase within the container may be avoided by the use of an overpressure valve, which may limit the pressure within the beverage container by opening at a certain pressure limit and relieving the inner space of the beverage container of any excessive pressure. However, any additional parts will increase the overall complexity and overall cost of the beverage container. As beverage containers are produced in very high numbers, it is necessary to keep the costs as low as possible.

It is therefore an object according to the present invention to provide technologies for avoiding overpressure related rupture of beverage containers while keeping the additional cost per unit low.

Prior Art

US 2008/0078769 A1 discloses a high pressure gas cylinder comprising a neck having an elongated throat and a mouth at an outer end of the throat. A plug and a piercable membrane are positioned within the throat at a substantial distance from the mouth. The high pressure gas cylinder further comprising a shipping cap removably mounted on the neck. The shipping cap includes at least two gas vent ports extending radially outwardly through the cap.

If the seal provided by the plug is breached, compressed gas exiting the gas cylinder through the throat exits the cap through the opposed radial vent ports. Because the vent ports are substantially identically configured, escaping gas will exit each of the vent ports at substantially equal flow volumes and exit velocities. Accordingly, the vents of the shipping cap prevent a breached bottle assembly from becoming a missile.

CN 2378333Y relates to a beer bottle washer made of plastic. The plastic washer is pressed elastically between the bottle mouth and cap. When the pressure inside the bottle increases to near a rupture critical pressure, the plastic washer loosens microscopically and part of the gas within the bottle may be released in order to reduce the rupture probability.

SUMMARY OF THE INVENTION

At least the above advantage, need and object or at least one of numerous further advantages, needs and objects, which will be evident from the below description of the present invention, is according to a first aspect of the present invention obtained by a container assembly for accommodating a carbonated beverage, the carbonated beverage defining a temperature dependent internal carbonization pressure, the container assembly comprising:

a beverage container having a body part defining an inner volume for accommodating the carbonated beverage and a cylindrical neck part defining a gas filled head space, the cylindrical neck part further defining a circumferential rim defining an opening and an outwardly oriented surface extending between the rim and the body part, the outwardly oriented surface having an outwardly oriented circumferential flange, the beverage container further defining a burst pressure being higher than the temperature dependent internal carbonization pressure at room temperature, a closure comprising a closure plate and a cylindrical part, the closure plate covering the opening at the rim and the cylindrical part covering the neck part between the rim and the circumferential flange, the cylindrical part comprising a locking part for arresting the outwardly oriented circumferential flange of the neck part, and a flexible sealing ring movable between a first position in which the sealing ring is accommodated in a compressed state entirely within a circumferential cavity defined between the cylindrical part of the closure and the outwardly oriented surface of the neck part at a location between the rim and the circumferential flange when the temperature dependent internal carbonization pressure is lower than or equal to the temperature dependent internal carbonization pressure at room temperature, and, a second position in which a larger part of the sealing ring is accommodated in a compressed state within the circumferential cavity defined between the cylindrical part of the closure and the outwardly oriented surface of the neck at a location between the rim and the circumferential flange, and a smaller part of the sealing ring is located in an uncompressed state within a groove in the cylindrical part and/or in the outwardly oriented surface and located adjacent the circumferential cavity for allowing fluid communication between the gas filled head space and the exterior of the beverage container when the temperature dependent internal carbonization pressure is higher than the temperature dependent internal carbonization pressure at room temperature.

Carbonated beverage should in the present context be understood to include both naturally carbonated beverages such as beer, cider, carbonated wine and certain natural mineral waters, and beverages which have been force-carbonated such as sodas, colas, soft drinks and certain sparkling wines. Carbonated beverages must be packaged in pressure proof containers and kept under pressure to avoid a continuous escape of carbon dioxide from the beverage which over time would result in a flat beverage. The dissolved carbon dioxide in the carbonated beverage forms equilibrium with its surrounding atmosphere and thus the pressure inside the container should correspond to the desired internal carbonization pressure of the beverage. The carbonization pressure of the beverage is temperature dependent and thus at increased temperatures, an equal amount of dissolved carbon dioxide will yield a higher internal carbonization pressure and consequently a higher pressure inside the container, in which the carbonated beverage is stored.

Typically, beverage containers define a larger cylindrical body part which is defining an inner space for accommodating most of or all of beverage stored in the container. The beverage containers also typically define a smaller and thinner cylindrical neck part which defines the opening of the beverage container. The neck part typically defines a gas filled head space comprising gaseous carbon dioxide in equilibrium with the dissolved carbon dioxide in the beverage. The head space pressure thus corresponds to the internal carbonization pressure of the beverage. The beverage container has a wall thickness and material composition for withstanding the pressure generated by the carbonated beverage under normal temperature conditions and in practice it is necessary to additionally include a safety margin so that the beverage container in reality is capable of withstanding a substantially higher pressure than the equilibrium pressure at room temperature. The burst pressure, i.e. the pressure at which the beverage container will rupture due to the pressure acting on the inner wall of the container, will vary due to manufacturing tolerances, voids in the container etc, however, for practical purposes the burst pressure is set to a theoretical "rated" pressure which an overwhelming majority of the containers will be capable of withstanding.

The closure comprises a closure plate which will form a tight fit with the rim, and a cylindrical part forming a skirt extending from the plate inherently molded to the plate to form a single part. The cylindrical part comprises a locking part which is intended to lock the closure in the right place on the neck by arresting the outwardly oriented circumferential flange on the outwardly oriented surface of the neck part. Specifically, the locking part arrests the outwardly oriented circumferential flange by grabbing the flange on the side facing away from the rim. In this way the closure will be firmly fastened to the neck part. Access to the interior of the container by the user is normally established via a piercable membrane in the closure plate and not by removing the closure altogether, although a complete removal of the closure may be an alternative option.

In order to seal the closure pressure tight to the neck, a flexible sealing ring is provided in a circumferential cavity between the rim and the circumferential flange and compressed between the outwardly oriented surface of the neck part and the cylindrical part of the closure. The sealing ring has a dual purpose. The first purpose is the above mentioned circumferential fluid and pressure tight sealing between the closure and the neck part of the container. This constitutes the first position.

Exceptionally, when the pressure for some reason increases within the container and approaches the burst pressure and thereby a risk of rupture can be expected, the flexible sealing ring will be pushed to a second position by the increased pressure. In the second position a part of the sealing ring is pushed downwardly in the direction of the force acting on the flexible sealing ring by the pressure difference between the head space and the exterior of the beverage container to a groove below the circumferential cavity. The part of the sealing ring which is located in the groove will be in a stretched and non-compressed state thus allowing excessive gas to pass from the head space of the beverage container to the exterior of the beverage container. This constitutes the second purpose of the sealing ring.

The groove may be provided either in the outwardly oriented surface of the neck part or the cylindrical part of the closure. The groove defines a greater distance between the outwardly oriented surface of the neck part or the cylindrical part of the closure than the width of the sealing ring, whereas the circumferential cavity defines a smaller distance between the outwardly oriented surface of the neck part or the cylindrical part of the closure. The groove is defined along a smaller circumference of the neck part, i.e. less than 50% of the circumference about the neck part, preferably 30% or less, more preferably 20% or less, most preferably 10% or less, such as 1%-5% or 5%-10%.

In the second position, a temporary fluid path between the inside of the container and the outside of the container is provided for releasing some gas from the head space inside the neck part of the container to the exterior of the container, thereby lowering the pressure inside the container and eliminating the risk of rupture. When the pressure has been reduced inside the beverage container, the stretched sealing ring re-assumes the first position in which the sealing ring is compressed between the outwardly oriented surface of the neck part and the cylindrical part of the closure. The movement between the first position and the second position is determined by the interaction between the pressurized gas of the head space, the sealing pressure and the elasticity, strength and flexibility of the sealing ring. The material of the O-ring should be temperature stable and capable of withstanding both low and high temperatures.

The main advantage of the present container assembly is thus that no additional parts are required for achieving the above mentioned release of overpressure, i.e. the already existing sealing ring is used together with a groove. Only the groove needs to be added to the existing containers.

When the container is in its standard use, i.e. sealed within a pressure chamber, it is fundamental that the pressure applied from the increased pressure outside the beverage container does not cause the O-ring to move from the first position to the second position, i.e. the O-ring should move due to the force caused by the relative pressure between the outside of the container and the inside of the container. The O-ring should not move in response to the absolute pressure inside of the container, or the pressure inside the container relative to the atmospheric pressure outside the pressure chamber.

According to a further embodiment of the first aspect, the sealing ring is movable between the first position and the second position along the outwardly oriented surface of the neck part. Preferably the friction between the sealing ring and the outwardly oriented surface of the neck part allows a part of the sealing ring to move along the outwardly oriented surface of the neck part.

According to a further embodiment of the first aspect, the sealing ring is elastically deformable between the first position and the second position in a direction perpendicular to the outwardly oriented surface of the neck part. Preferably, the sealing ring is elastically deformable for determining a proper pressure at which the sealing ring will move from the first position to the second position.

According to a further embodiment of the first aspect, the beverage container is collapsible. The present container assembly is preferably used together with a collapsible container as collapsible containers preferably are made thin, and thereby more prone to rupture, for allowing the containers to be compressed using a lower compression pressure, According to a further embodiment of the first aspect, the room temperature is considered to be between 0° C. and 60° C., preferably between 10° C. and 40° C., more preferably between 15° C. and 30° C., most preferably between 20° C. and 25° C., such as 22° C. The above temperatures may be considered indicative for room temperature in the present circumstances.

According to a further embodiment of the first aspect, the temperature dependent internal carbonization pressure at room temperature is between 0.5 barg and 8 barg, preferably between 1 barg and 4 barg, more preferably between 1 barg and 2 barg or alternatively between 2 barg and 3 barg or alternatively between 3 barg and 4 barg. The above pressures may be considered indicative for internal carbonization pressure for many carbonated beverages such as beer etc. at the above room temperature in the present circumstances.

According to a further embodiment of the first aspect, the sealing ring moves from the first position to the second position when the internal carbonization pressure is between 4 barg and 12 barg, preferably between 6 barg and 10 barg, more preferably between 6 barg and 8 barg or alternatively between 8 barg and 10 barg. The above pressures are suitable in order to have a proper safety margin for the container while avoiding that pressurization gas is released from the container when the container is only heated slightly and the head space pressure is still safe, since already released gas cannot be re-introduced into the container.

According to a further embodiment of the first aspect, the burst pressure is between 8 barg and 40 barg, preferably between 10 barg and 20 barg, more preferably between 12 barg and 14 barg or alternatively between 14 barg and 16 barg. The above pressures may be considered indicative for burst pressure in the present circumstances.

According to a further embodiment of the first aspect, the groove has a circular, elliptic, rectangular, quadratic or superelliptic cross section. Variously shaped grooves may be used, however, typically the groove has a circular cross section.

According to a further embodiment of the first aspect, the sealing ring has a circular, elliptic, rectangular, quadratic or superelliptic cross section. Variously shaped sealing rings may be used, however, typically the sealing ring has a circular cross section.

According to a further embodiment of the first aspect, the groove has a cross sectional dimension in the range between 1 mm and 10 mm, preferably between 2 mm and 5 mm, more preferably between 3 mm and 4 mm. The groove should not be too large or extend about a too large circumference of the neck part of the container, since only a small fluid path is desired, and the sealing ring may not be sufficiently stretched to be capable to resume the first position in case the groove is too large. The above mentioned values are recommended in the present circumstances for standard sized beverage containers, i.e. containers ranging between 1 litre and 60 litres.

According to a further embodiment of the first aspect, the outwardly oriented surface is tapered towards the rim at the location of the groove. In this way, the flexible sealing ring will be wedged into sealed position due to the pressure difference between the head space and the exterior of the beverage container.

According to a further embodiment of the first aspect, the cylindrical part of the closure is tapered towards the closure plate at the location of the groove. Alternatively or in addition, the cylindrical part of the closure may be tapered for the same purpose.

At least the above advantage, need and object or at least one of numerous further advantages, needs and objects, which will be evident from the below description of the present invention, are according to a second aspect of the present invention obtained by a preform assembly for producing a container assembly, the preform assembly comprising:

a preform having a body part for being blow moulded into an inner volume for accommodating a carbonated beverage defining a temperature dependent internal carbonization pressure and a cylindrical neck part for defining a gas filled head space, the cylindrical neck part further defining a circumferential rim defining an opening and an outwardly oriented surface extending between the rim and the body part, the outwardly oriented surface having an outwardly oriented circumferential flange, a closure comprising a closure plate and a cylindrical part, the closure plate covering the opening at the rim and the cylindrical part covering the neck part between the rim and the circumferential flange, the cylindrical part comprising a locking part for arresting the outwardly oriented circumferential flange of the neck part, and, a flexible sealing ring movable between a first position in which the sealing ring is accommodated in a compressed state entirely within a circumferential cavity defined between the cylindrical part of the closure and the outwardly oriented surface of the neck part at a location between the rim and the circumferential flange when the temperature dependent internal carbonization pressure is lower than or equal to the temperature dependent internal carbonization pressure at room temperature, and, a second position in which a larger part of the sealing ring is accommodated in a compressed state within a circumferential cavity defined between the cylindrical part of the closure and the outwardly oriented surface of the neck at a location between the rim and the circumferential flange, and a smaller part of the sealing ring is located in an uncompressed state within a groove in the cylindrical part and/or in the outwardly oriented surface and located adjacent the circumferential cavity for allowing fluid communication between the gas filled head space and the exterior of the beverage container when the temperature dependent internal carbonization pressure is higher than the temperature dependent internal carbonization pressure at room temperature.

The preform assembly according to the second aspect may preferably be used to manufacture the beverage container assembly according to the first aspect.

At least the above advantage, need and object or at least one of numerous further advantages, needs and objects, which will be evident from the below description of the present invention, are according to a third aspect of the present invention obtained by a method of producing a container assembly, the method comprising the steps of:

providing a beverage container having a body part defining an inner volume for accommodating a carbonated beverage defining a temperature dependent internal carbonization pressure and a cylindrical neck part defining a gas filled head space, the cylindrical neck part further defining a circumferential rim defining an opening and an outwardly oriented surface extending between the rim and the body part, the outwardly oriented surface having an outwardly oriented circumferential flange, the beverage container further defining a burst pressure being higher than the temperature dependent internal carbonization pressure at room temperature, applying a flexible sealing onto the outwardly oriented surface of the neck at a location between the rim and the circumferential flange, and applying a closure comprising a closure plate and a cylindrical part, the closure plate covering the opening at the rim and the cylindrical part covering the neck part between the rim and the circumferential flange, the cylindrical part comprising a locking part for arresting the outwardly oriented circumferential flange of the neck part, the sealing ring being movable between a first position in which the sealing ring is accommodated in a compressed state entirely within a circumferential cavity defined between the cylindrical part of the closure and the outwardly oriented surface of the neck part at a location between the rim and the circumferential flange when the temperature dependent internal carbonization pressure is lower than or equal to the temperature dependent internal carbonization pressure at room temperature, and, a second position in which a larger part of the sealing ring is accommodated in a compressed state within the circumferential cavity defined between the cylindrical part of the closure and the outwardly oriented surface of the neck at a location between the rim and the circumferential flange and a smaller part of the sealing ring is located in an uncompressed state within a groove in the cylindrical part and/or in the outwardly oriented surface and located adjacent the circumferential cavity for allowing fluid communication between the gas filled head space and the exterior of the beverage container when the temperature dependent internal carbonization pressure is higher than the temperature dependent internal carbonization pressure at room temperature.

The method according to the third aspect may preferably be used to manufacture the beverage container assembly according to the first aspect.

BRIEF DESCRIPTION OF THE DRAWINGS

FIG. 5A is a side view of the beverage container.

FIG. 5B is a close-up view of the groove as shown in the previous figure.

FIG. 5C is a side cut view of the beverage container.

FIG. 5D is a top cut view of the beverage container.

FIG. 5E is a close-up view of the groove as shown in the previous figure.

DETAILED DESCRIPTION OF THE DRAWINGS

Figure 1:
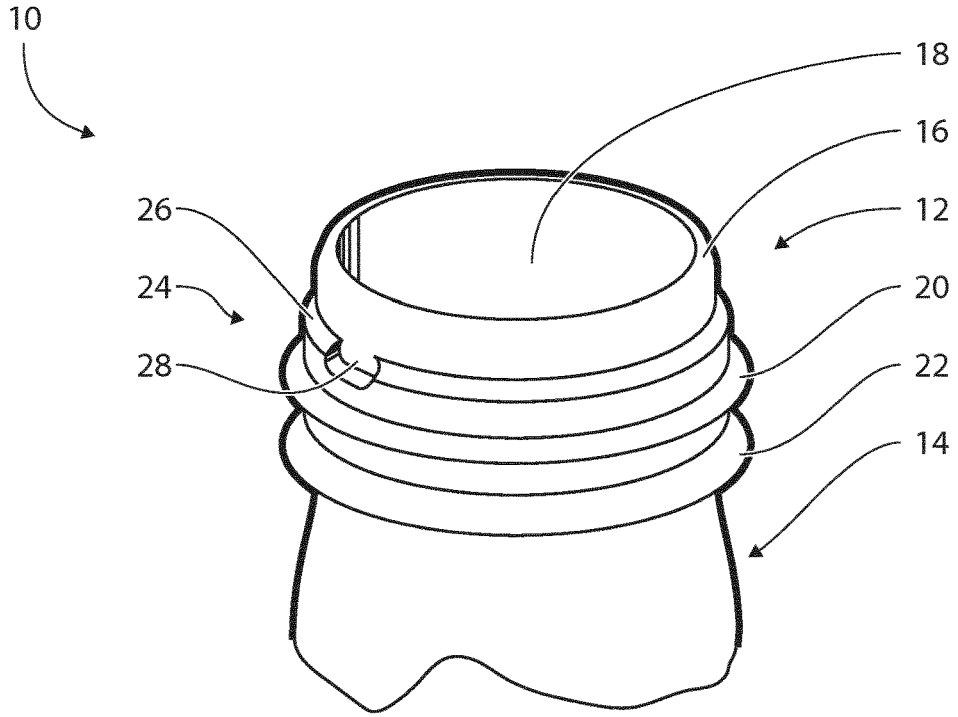
FIG. 1 is a perspective view of a beverage container according to the present invention.

FIG. 1 shows a perspective view of a beverage container 10 according to the present invention. The beverage container 10 comprise a neck part 12 defining a gas filled head space and a body part 14 typically filled by carbonated beverage. The neck part is cylindrical and inherently joined to the body part 14. The body part 14 is only partially shown and is typically cylindrical having a size between two and twenty liters, however various shapes and sizes are contemplated. The beverage container 10 may be made of blow moulded plastic, e.g. PET.

The neck part 12 comprises a circular rim 16 defining an opening 18 for accessing the interior of the beverage container 10. The neck part 12 further comprises a circumferential flange 20 and an optional additional flange 22. The circumferential flange 20 is used for closing off the beverage container 10 as will be described further below, whereas the optional additional flange 22 is used for handling the beverage container 10 during blow moulding, transport, etc so that the circumferential flange 20 may be preserved.

The neck part 12 defines an outwardly oriented surface 24 extending between the rim 16 and the circumferential flange 20. The outwardly oriented surface 24 comprises an optional tapering 26 encircling the greater part of the circumference defined by the outwardly oriented surface 24 and a groove 28 which occupies the remaining smaller part of the circumference defined by the outwardly oriented surface 24. The groove 28 defines an indentation in the outwardly oriented surface 24.

Figure 2:
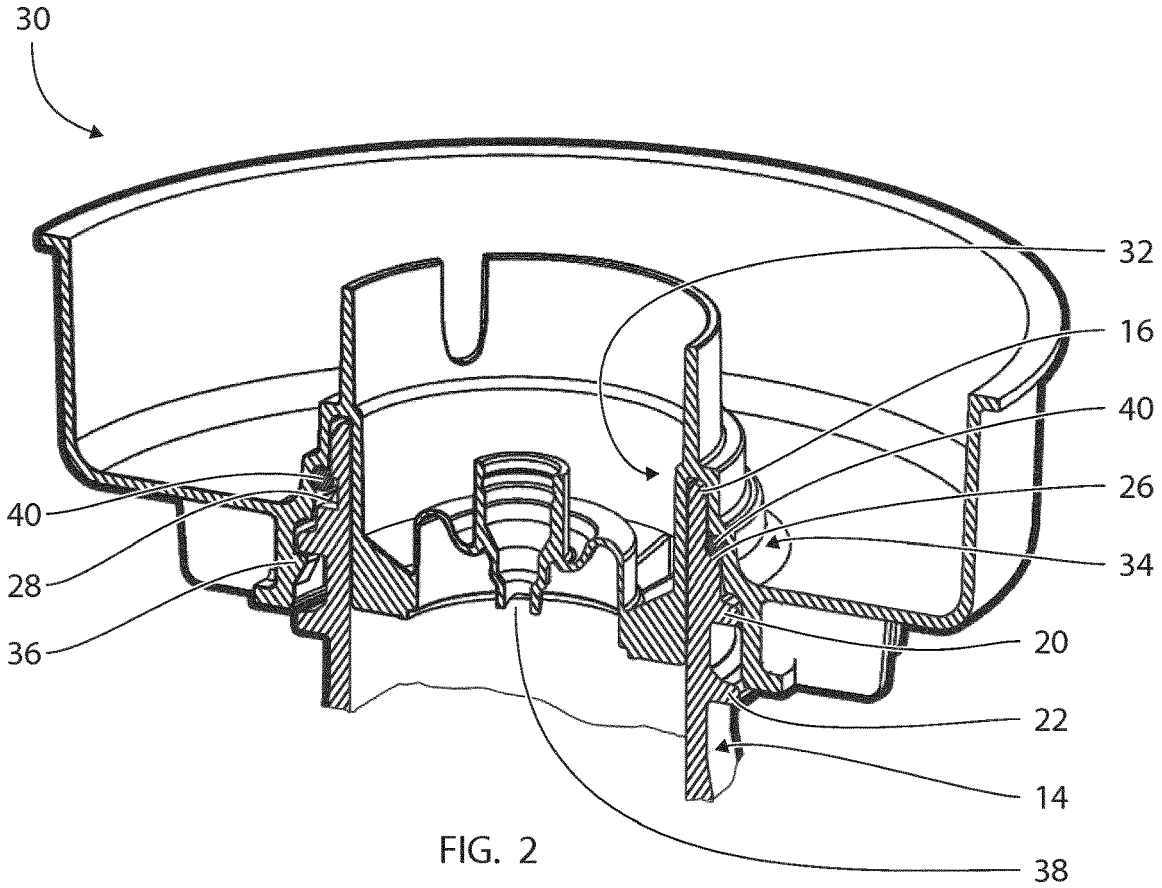
FIG. 2 is a perspective view of a closure according to the present invention.

FIG. 2 shows a perspective cut view of a closure 30 according to the present invention. The closure 30 illustrated here is of the type used for larger containers 10 of about 5 liters and more. The closure 30 comprises a closure plate 32 which is closing off the opening 18 at the rim 16. The closure 30 further comprises a cylindrical part 34 which is covering the outwardly oriented surface 24 of the neck part 12.

The cylindrical part 34 of the closure 30 further comprises a locking part 36 which is snap fitted onto the circumferential flange 20 so that the closure 30 is arrested to the beverage container 10. The locking part 36 is thereby located on the opposite side of the circumferential flange 20 as seen from the rim 16 of the beverage container 10. Access to the beverage container 10 is typically achieved by a piercable membrane 38 in the closure plate 32.

The assembly comprising the beverage container 10 and the closure 30 further comprise a sealing ring 40 which is compressed or squeezed in a circumferential cavity established between the cylindrical part 34 of the closure 30 and the outwardly oriented surface 24 of the neck part 12 and between the rim 16 and the circumferential flange 20 of the neck part 12, preferably adjacent the tapering 26. A pressure tight sealing is thereby achieved by the elastical compression of the sealing ring 40 against the surfaces establishing the above mentioned cavity.

Figure 3:
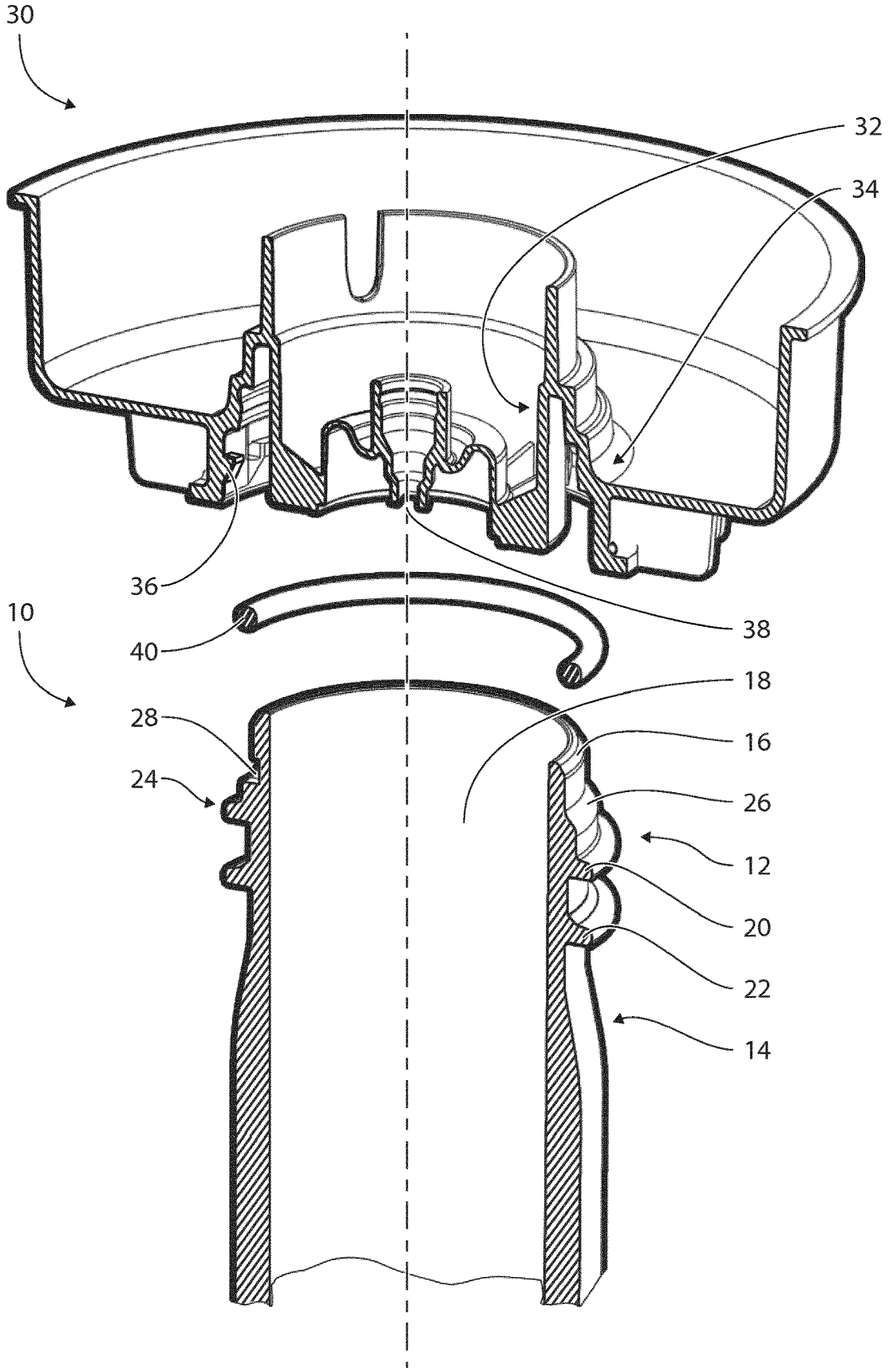
FIG. 3 is a perspective view of a container assembly when being assembled.

FIG. 3 shows a perspective cut view of a container assembly comprising the beverage container 10, the closure 30 and the sealing ring 40. It is thereby understood that when assembling the container assembly selectively, the sealing ring 40 may be applied to the container 10 or the closure 30 before the container is filled and capped. The sealing ring is typically made of a flexible and elastic polymeric material such as rubber or a synthetic food-graded elastomer. The sealing ring 40 is typically torus shaped and should be dimensioned for a tight fit between the closure 30 and the beverage container 10.

Figure 4A:
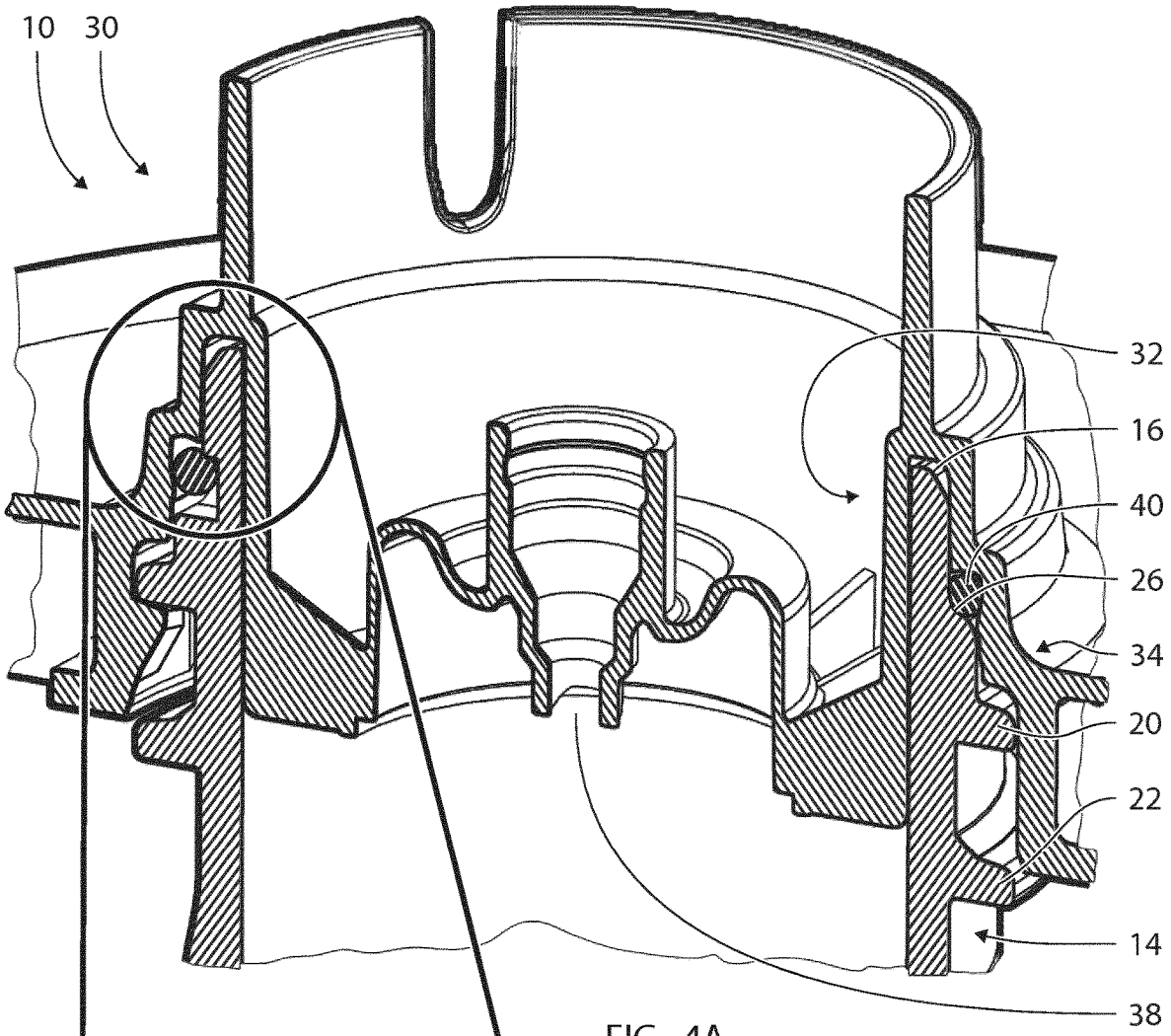
FIG. 4A is a perspective view of a container assembly when assembled.

FIG. 4A shows a perspective cut view of the beverage container assembly when assembled and including carbonated beverage in equilibrium with the gas filled head space within the neck part 12 of the beverage container 10. The sealing ring 40 is applying a sealing pressure within the cavity between the cylindrical part 34 of the closure 30 and the outwardly oriented surface 24 of the neck part 12 as shown in the right side of the cut. At the location of the groove 28, which is shown at the left side of the cut, the sealing ring 40 still seals between the cylindrical part 34 of the closure 30 and the outwardly oriented surface 24 of the neck part 12.

Figure 4B:
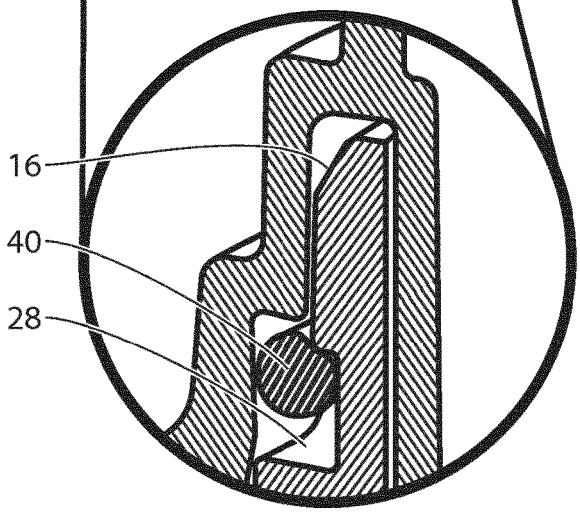
FIG. 4B is a close-up perspective view of the sealing ring in the first state.

FIG. 4B shows a close-up perspective cut view of the sealing ring 40 in the first position at the location of the groove 28. The present situation shows the first position of the sealing ring 40 when the pressure inside the beverage container 10 is corresponding to the equilibrium pressure of the carbonated beverage at room temperature. The pressure force applied onto the sealing ring 40 is not sufficient for moving the sealing ring 40 to the second position.

Figure 4C:
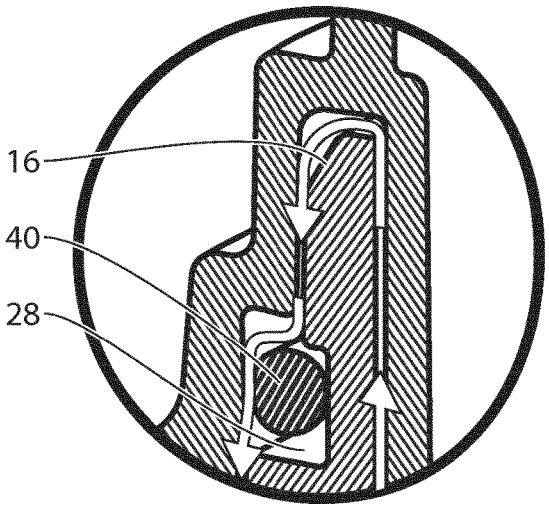
FIG. 4C is a close-up perspective view of the sealing ring in the second state.

FIG. 4C shows a close-up perspective cut view of the sealing ring 40 in the second position at the location of the groove 28. The pressure inside the beverage container 10 is now elevated above the equilibrium pressure of the carbonated beverage at room temperature, e.g. by elevating the temperature of the beverage. When approaching the burst pressure of the beverage container 10, in order to prevent rupture of the beverage container 10, the increased pressure causes the sealing ring 40 to elastically deform and stretch at the location of the groove 28 so that the sealing ring 40, at the location of the groove 28, will move into the groove 28. The groove defines an enlarged distance between the cylindrical part 34 of the closure 30 and the outwardly oriented surface 24 of the neck part 12 compared to the tapering 26, and thus the sealing ring 40 will not be compressed at the location of the groove 28 and thus no sealing pressure is applied between the cylindrical part 34 of the closure 30 and the outwardly oriented surface 24 of the neck part 12 at the location of the groove 28 when in the second position.

The lack of sealing pressure between the outwardly oriented surface 24 of the neck part 12 at the location of the groove 28 will allow some gas from the head space to escape from the inside of the beverage container 10 to the exterior of the beverage container 10 as shown by the arrows. When the pressure inside the beverage container is reduced to a safe level, the elastomeric sealing ring 40 will generally not resume the first position compressed between the cylindrical part 34 of the closure 30 and the outwardly oriented surface 24 of the neck part 12 but maintain the uncompressed position within the groove 28. In this way it may be established whether or not the container has been subjected to a pressure increase caused by e.g. high temperatures or uncontrolled fermentation. It is, however, contemplated that in some embodiments it may be appreciated to allow the sealing ring 40 to resume the first position instead of a one way function of the sealing ring 40.

FIG. 5A/B shows a side view of the beverage container 10. In the present view, the groove 28 is viewed front-on. In the present embodiment, the groove is superelliptic; however, it may also be circular, rectangular or any other shape. The width of the groove is in the present embodiment between 1-2 mm.

FIG. 5C shows a side cut view of the beverage container 10. In the present view, the groove 28 is viewed side-on illustrating the reduced diameter of the outwardly oriented surface 24 at the location of the groove 28.

FIG. 5D/E show a top cut view of the beverage container 10. In the present view, it can be seen that the groove 28 forms an indentation in the outwardly oriented surface 24 of the neck part 12. The indentation is deeper than the circumference formed by outwardly oriented surface 24 outside the groove 28.

Figure 6A:
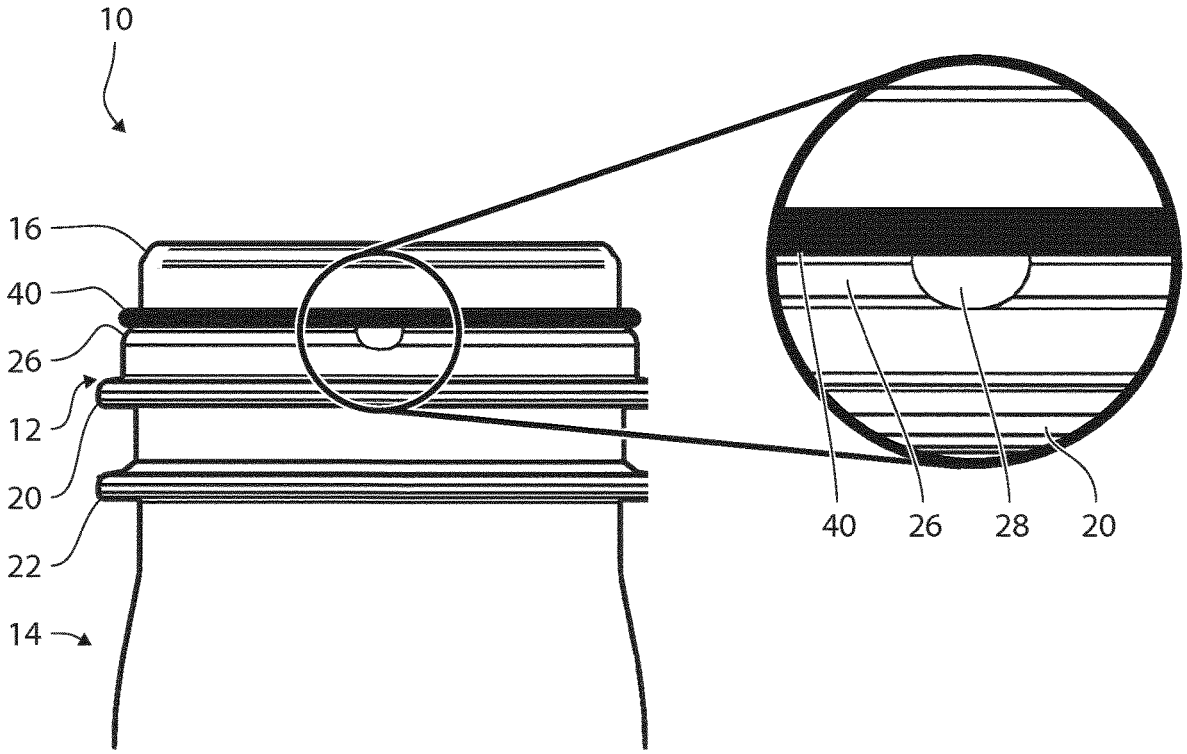
FIG. 6A is a side view of the assembly when the sealing ring is in the first position.

FIG. 6A shows a side view of the assembly when the sealing ring 10 is in the first position. The sealing ring 40 is compressed between the cylindrical part (not shown) and the outwardly oriented surface 24 at a location above the groove 28.

Figure 6B:
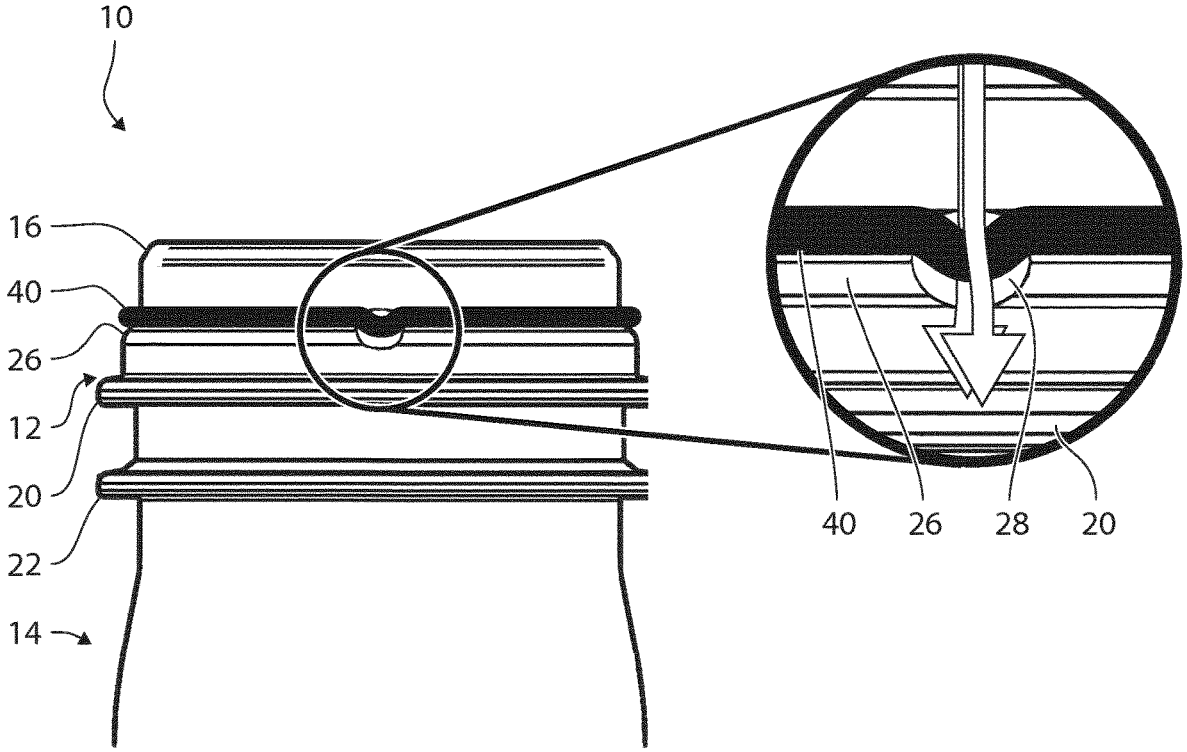
FIG. 6B is a side view of the assembly when the sealing ring is in the second position.

FIG. 6B shows a side view of the assembly when the sealing ring 10 is in the second position. The sealing ring 40 is at the location above the groove 28 stretched from the compressed position into a non-compressed position in the groove 28, thereby allowing gas to pass as illustrated by the arrows.

It is evident to the skilled person that the above described embodiments only describe one out of numerous embodiments envisaged according to the present invention and that the above embodiments may be modified in numerous ways without departing from the inventive idea as described by the appending claims. As an example, both the tapering and the groove may be part of the closure instead of the neck part.

LIST OF PARTS WITH REFERENCE TO THE DRAWINGS

10. Beverage container
12. Neck part
14. Body part (partial view)
16. Rim
18. Opening
20. Circumferential flange
22. Additional flange
24. Outwardly oriented surface
26. Tapering
28. Groove
30. Closure
32. Closure plate
34. Cylindrical part
36. Locking part
38. Piercable membrane
40. Flexible sealing ring

The invention claimed is:

1. A container assembly for accommodating a carbonated beverage, said carbonated beverage defining a temperature dependent internal carbonization pressure, said container assembly comprising:

a beverage container having a body part defining an inner volume for accommodating said carbonated beverage, and a cylindrical neck part defining a gas filled head space, said cylindrical neck part further defining a circumferential rim defining an opening, said beverage container further defining a burst pressure higher than said temperature dependent internal carbonization pressure at room temperature;

an outwardly oriented surface extending circumferentially around said neck part below said rim, said outwardly oriented surface being interrupted by an indentation defining a groove in said outwardly oriented surface;

a circumferential flange on said neck part below said outwardly oriented surface;

a flexible sealing ring installed on said neck part above said outwardly oriented surface; and a closure comprising a closure plate and a cylindrical part extending from said closer plate, said closure plate configured for covering said opening at said rim, and said cylindrical part configured for circumferentially covering a portion of said neck part including said outwardly oriented surface and said circumferential flange, said cylindrical part comprising a locking part configured for snap fitting with said circumferential flange, wherein, when said closure is installed on said neck part, said cylindrical part defines, with said neck part and said outwardly oriented surface, a circumferential cavity in which said sealing ring is accommodated in a compressed state, said circumferential cavity being open to said groove in said outwardly oriented surface;

wherein said flexible sealing ring is movable between a first position in which said sealing ring is accommodated in said compressed state entirely within said circumferential cavity to provide a seal between said neck part and said cylindrical part of said closure when said temperature dependent internal carbonization pressure is lower than or equal to a room temperature internal carbonization pressure, and a second position in which a larger part of said sealing ring is accommodated in a compressed state within said circumferential cavity, and a smaller part of said sealing ring is elastically deformed downward into said groove in an uncompressed state to break said seal in response to said temperature dependent internal carbonization pressure being higher than said room temperature internal carbonization pressure, thereby allowing fluid communication from said gas filled head space to the exterior of said beverage container through said circumferential cavity and said groove.

2. The container assembly according to claim 1, wherein said sealing ring is movable between said first position and said second position along said outwardly oriented surface of said neck part.

3. The container assembly according to claim 1, wherein said sealing ring is elastically deformable between said first position and said second position in a direction perpendicular to said outwardly oriented surface of said neck part.

4. The container assembly according to claim 1, wherein said beverage container is collapsible.

5. The container assembly according to claim 1, wherein said room temperature is between 0° C. and 60° C.

6. The container assembly according to claim 1, wherein said temperature dependent internal carbonization pressure at room temperature is between 0.5 barg and 8 barg.

7. The container assembly according to claim 1, wherein said sealing ring moves from said first position to said second position when said internal carbonization pressure is between 4 barg and 12 barg.

8. The container assembly according to claim 1, wherein said burst pressure is between 8 barg and 40 barg.

9. The container assembly according to claim 1, wherein said groove has a cross-sectional shape selected from the group consisting of circular, elliptic, rectangular, quadratic, and superelliptic.

10. The container assembly according to claim 1, wherein said sealing ring has a cross-sectional shape selected from the group consisting of circular, elliptic, rectangular, quadratic, and superelliptic.

11. The container assembly according to claim 1, wherein said groove has a cross sectional dimension in the range of 1 mm and 10 mm.

12. The container assembly according to claim 1, wherein said outwardly oriented surface is tapered towards said rim at the location of said groove.

13. The container assembly according to claim 1, wherein said cylindrical part of said closure is tapered towards said closure plate at the location of said groove.

14. A preform assembly for producing a container assembly, said preform assembly comprising:

a preform configured for being blow-molded into a container having a body part defining an inner volume for accommodating a carbonated beverage, said carbonated beverage defining a temperature dependent internal carbonization pressure, and a cylindrical neck part defining a gas filled head space, said cylindrical neck part including a circumferential rim defining an opening, and an outwardly oriented surface extending circumferentially around said neck part below said rim, said outwardly oriented surface being interrupted by an indentation defining a groove in said outwardly oriented surface, said neck part further including a circumferential flange below said outwardly oriented surface;

a closure comprising a closure plate and a cylindrical part extending from said closer plate, said closure plate configured for covering said opening at said rim, and said cylindrical part configured for circumferentially covering a portion of said neck part including said outwardly oriented surface and said circumferential flange, said cylindrical part comprising a locking part configured for snap fitting with said circumferential flange, wherein, when said closure is installed on said neck part, said cylindrical part defines a circumferential cavity with said neck part and said outwardly oriented surface, said circumferential cavity being open to said groove in said outwardly oriented surface; and a flexible sealing ring accommodated in said circumferential cavity and maintained in a compressed state by the cylindrical part of the closure, said flexible sealing ring being movable between a first position in which said sealing ring is accommodated in said compressed state entirely within said circumferential cavity to provide a seal between said neck part and said cylindrical part of said closure when said temperature dependent internal carbonization pressure is lower than or equal to a room temperature internal carbonization pressure, and a second position in which a larger part of said sealing ring is accommodated in a compressed state within said circumferential cavity, and a smaller part of said sealing ring is elastically deformed downward into said groove in an uncompressed state to break said seal in response to said temperature dependent internal carbonization pressure being higher than said room temperature dependent internal carbonization pressure, thereby allowing fluid communication from said gas filled head space to the exterior of said beverage container through said circumferential cavity and said groove.

15. A method of producing a container assembly, said method comprising the steps of:

providing a beverage container having a body part defining an inner volume for accommodating a carbonated beverage and a cylindrical neck part defining a gas filled head space, said beverage container having a burst pressure higher than a temperature dependent internal carbonization pressure at room temperature of said carbonated beverage in said container, said cylindrical neck part defining a circumferential rim defining an opening, and an outwardly oriented surface extending circumferentially around said neck part below said rim, said outwardly oriented surface being interrupted by a groove defining an indentation in said outwardly oriented surface, said neck part further including a circumferential flange below said outwardly oriented surface;

installing a flexible sealing ring around said neck part so as to seat against said outwardly oriented surface above said groove; and applying a closure to said neck part of said container, said closure comprising a closure plate and a cylindrical part extending from said closer plate, wherein applying said closure includes:

covering said opening at said rim with said closure plate, and circumferentially covering a portion of said neck part including said outwardly oriented surface and said circumferential flange with said cylindrical part, whereby a circumferential cavity is formed above said outwardly oriented surface between said neck part and said cylindrical part of said closure, said circumferential cavity being open to said groove; and snapping a locking part of said cylindrical part onto said circumferential flange of said neck part, whereby said sealing ring is accommodated entirely in a compressed state within said circumferential cavity, wherein said sealing ring includes a portion that deforms downward into said groove in an uncompressed state in response to an internal temperature dependent internal carbonization pressure in said container being higher than said temperature dependent internal carbonization pressure at room temperature, thereby allowing fluid communication from said gas filled head space to the exterior of said beverage container through said circumferential cavity and said groove.

* * * * *